313-414 SR
12/2/86 OR 4,626,738

United States Patent [19]

Gerlach

[11] Patent Number: 4,626,738

[45] Date of Patent: Dec. 2, 1986

[54] COLOR DISPLAY TUBE WITH ELECTROSTATIC FOCUSING LENS

[75] Inventor: Hans G. Gerlach, Eindhoven, Netherlands

[73] Assignee: U.S. Philips Corporation, New York, N.Y.

[21] Appl. No.: 635,776

[22] Filed: Jul. 30, 1984

[30] Foreign Application Priority Data

Aug. 5, 1983 [NL] Netherlands ..... 8302752

[51] Int. Cl.[4] ..... H01J 29/62

[52] U.S. Cl. ..... 313/414; 313/449

[58] Field of Search ..... 313/414, 449

[56] References Cited

U.S. PATENT DOCUMENTS 4,370,592 1/1983 Hughes et al. ..... 313/449 X
4,535,266 8/1985 Say ..... 313/414

FOREIGN PATENT DOCUMENTS 40755 3/1983 Japan ..... 313/414

*Primary Examiner*—Palmer C. DeMeo
*Attorney, Agent, or Firm*—Robert J. Kraus

[57] ABSTRACT

A color display tube comprising an evacuated envelope (1) composed of a neck (4), a cone (3) and a display window (2), contains in the neck a system of electron guns (5) with which three electron beams are generated. The beams are situated with their axes in one plane and are focused by means of a focusing lens field on a display screen (10) provided on the inside of the display window. The focusing lens field is formed between two electrodes (25, 26) of the electron gun system which are situated behind each other along the axes. The electrodes comprise facing outermost rims (32, 33) and includes respective apertures (38, 39, 40), (42, 43, 44) which are symmetrical with respect to the plane and through which the electron beams pass within the rims. The apertures are formed in recessed parts (34, 41) extending substantially at right angles to the axes. By making the shape of at least one of the central apertures (39, 43) so that, in addition to providing a quadrupole component, it substantially compensates an eight-pole component in the focusing lens field at the area of the central electron beam, and by making the shape of the outermost apertures in at least one of the electrodes so that, in addition to providing a quadrupole component, they substantially compensate a six-pole component in the focusing lens field at the area of the outermost electron beams, a better spot on the display screen is obtained.

6 Claims, 6 Drawing Figures

COLOR DISPLAY TUBE WITH ELECTROSTATIC FOCUSING LENS

BACKGROUND OF THE INVENTION

The invention relates to a colour display tube comprising an evacuated envelope which is composed of a neck, a cone and a display window. In the neck a system of electron guns with which three electron beams situated with their axes in one plane are generated. The beams are focused, by means of a focusing lens field, on a display screen which is provided on the inside of the display window. The focusing lens field is formed between two electrodes of the system of electron guns situated one behind the other along the axes. The electrodes comprise outer rims facing each other and within these rims three apertures through which the electron beams pass are provided symmetrically with respect to the plane in a recessed part extending substantially at right angles to the axes.

Such a colour display tube is known from U.S. Pat. No. 4,370,592. It is stated in the Patent Specification that the focusing lens field generated in this manner is still astigmatic and the electron beams are focused vertically more strongly than horizontally. As described in the Patent Specification, the astigmatism is corrected by providing the second electrode of the focusing lens with a plate having an elongate slot which is provided on the side of the display screen. The slot is situated symmetrically with respect to the plane through the beam axes. However, it has been found that the corrections of the horizontal/vertical astigmatism are not sufficient since the quality of the spot on the display screen leaves something to be desired.

United Kingdom Patent Application No. 2,112,564 also describes such a colour display tube. The horizontal/vertical astigmatism is eliminated by making the apertures in the recessed part elongate. This is also not sufficient to get smaller spot dimensions.

SUMMARY OF THE INVENTION

It is therefore an object of the invention to provide measures to improve the quality of the spot and to obtain smaller dimensions of the spot than with the known tubes with comparable beam currents.

For that purpose, according to the invention, a colour display tube of the kind described in the opening paragraph is characterized in that the shape of the central aperture in at least one of the electrodes is such that, in addition to providing a quadrupole component, it substantially compensates for an eight-pole component in the forcusing lens field at the area of the central electron beam, and the shape of the electrodes is such that, in addition to providing a quadrupole component, they substantially compensate for a six-pole component in the focusing lens field at the area of the outermost electron beams.

The invention is based on the recognition obtained experimentally and from computations that, because the three electron beams are situated with their axes in one plane and within facing outermost rims, not only does a different focusing in a horizontal and a vertical direction takes place, but also in directions situated inbetween. Around the central beam is formed in particular an eight-pole component and around the outer beams is formed in particular a six-pole component in the focusing lens field. These multipole components must be compensated for at least for the greater part. According to the invention this can be done by giving the apertures in the electrodes between which the focusing lens field is generated such a shape deviating from a circular aperture that in addition to the quadrupole component for the central beam, a compensating eight-pole component is obtained and for the outermost beams a compensating six-pole component is obtained. The horizontal/-vertical astigmatism can be compensated for substantially by the quadrupole component in the lens field. However it is also possible to allow a quantity of horizontal/vertical astigmatism to be present in the focusing lens field which then compensates for the astigmatism of the deflection coils.

It has also been found that there is an optimum distance by which the outer rim projects beyond the recessed part. Therefore, a first preferred embodiment of a colour display tube in accordance with the invention is characterized in that the outer rim projects beyond the recessed part by a distance which is equal to 10 to 25% of the largest diameter of the recessed portion within the outer rim.

When the distance is smaller, the influence of the shape of the apertures on the lens field predominates and reduces the effective lens diameter. When the distance is larger, the influence of the apertures is too small to be able to readily correct the aberrations. The electrodes usually have an oval cross-section at right angles to the longitudinal axis of the system of electron guns. However, it is also possible for the electrodes to have a circular orthogonal cross-section. A compensating eight-pole component in the focusing lens field can be generated by making the central aperture in the recessed portion of the first and/or the second electrode substantially octagonal as well as elongate to obtain a quadrupole component. A compensating six-pole component in the focusing lens field can be generated by making the outermost apertures substantially pear-shaped. A second preferred embodiment of the colour display tube in accordance with the invention is therefore characterized in that, viewed in the direction of propagation of the electron beams, the central aperture in at least the first electrode of the two electrodes between which the focusing lens field is formed is elongate, the long axis being at right angles to the plane, the edge of the aperture forming substantially an octagon, the outermost apertures being pear-shaped and the edges of the apertures, viewed from the central aperture, converging with distance from the central aperture. A focusing lens formed between two electrodes may be considered to be composed of two lens parts, a positive lens part (equipotential lines convex in the direction of the electrode of low potential) and a weaker negative lens part (equipotential lines convex in the direction of the electrode of high potential). The strength of the positive lens part is always greater that that of the negative lens part, so that the two lens parts together have a positive lens action.

If the apertures in the second electrode of the focusing lens have the same shape as the apertures in the first electrode, the influence of the apertures in the first electrode on the positive lens part is attenuated by the influence of the apertures in the second electrode on the negative lens part. This will be discussed hereinafter.

A third preferred embodiment of the colour display tube in accordance with the invention is characterized in that, viewed in the direction of propagation of the electron beams, the central aperture in the second electrode of the two electrodes between which the focusing lens field is formed is elongate, the long axis of said aperture being situated in the plane, the edge of the aperture substantially forming an octagon, the outermost apertures being substantially pear-shaped, the edges of the apertures, viewed from the central aperture, diverging with distance from the central aperture.

By constructing the apertures in the second electrode in this manner, the desired correction can also be obtained. The desired correction can also be achieved by combination of the first and the second preferred embodiments. It will be obvious that the desired eight-pole and six-pole components can also be obtained by providing, for example, an elongate, substantially octagonal central aperture in the first electrode with the long axis of the aperture at right angles to the plane and two outwardly diverging, substantially pear-shaped, outermost apertures in the second electrode of the focusing lens. It is also possible to obtain the desired eight-pole and six-pole components, for example, by providing an elongate, substantially octagonal central aperture having its long axis in the plane in the second electrode and two outwardly converging, substantially pear-shaped outermost apertures in the first electrode. However, from a technical point of view of production this is less attractive.

The pear-shaped apertures are obtained in a simple manner by composing them, viewed from the central aperture, of outwardly or inwardly converging isosceles trapeziums which are closed by arcs of circles on the outside and/or inside.

BRIEF DESCRIPTION OF THE DRAWING

The invention will now be described in greater detail, by way of example, with reference to the accompanying drawing, in which.

DESCRIPTION OF THE PREFERRED EMBODIMENTS

Figure 1:
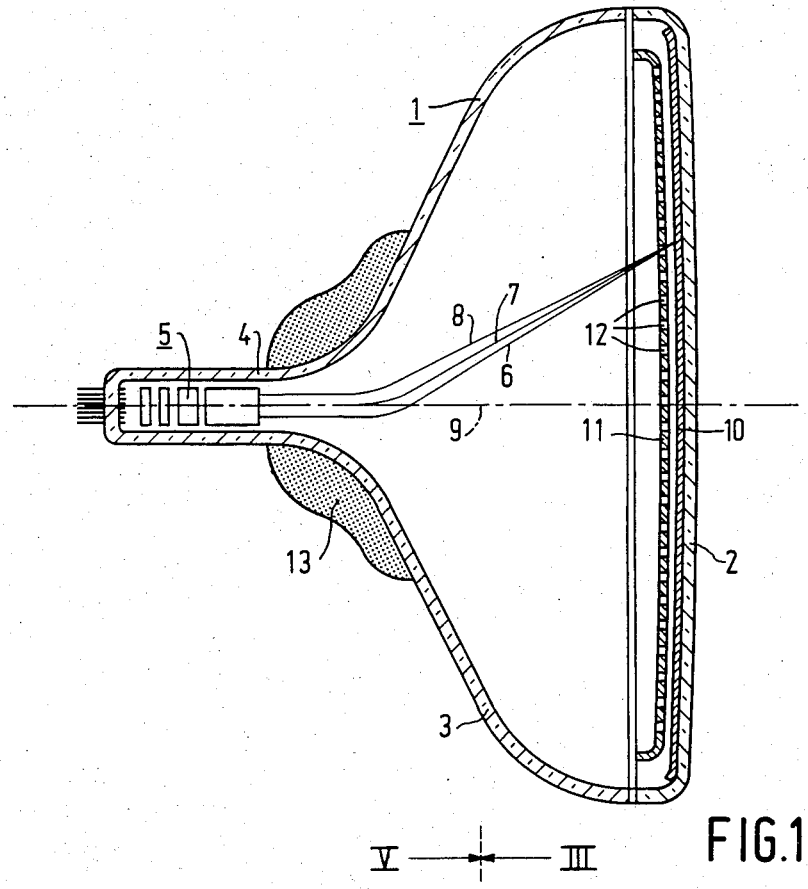
FIG. 1 is a longitudinal sectional view of a colour display tube according to the invention.

FIG. 1 is a longitudinal sectional view of a colour display tube of the so-called "in-line" type. An integrated electron gun system 5 is provided in a glass envelope 1 which is composed of a display window 2, a cone 3, and a neck 4; the electron gun system generates three electron beams 6,7 and 8 which are situated with their axes in the plane of the drawing. The axis of the central electron beam 7 initially coincides with the tube axis 9. On its inside the display window 2 comprises a large number of triplets of phosphor lines. Each triplet comprises a line consisting of a blue-luminescing phosphor, a line consisting of a green-luminescing phosphor and a line consisting of a red-luminescing phosphor. All triplets together constitute the display screen 10. The phosphor lines are at right angles to the plane of the drawing. In front of the display screen is positioned the shadow mask 11 in which a large number of elongate apertures 12 are provided through which the electron beams 6, 7 and 8 pass, which beams each impinge only on phosphor lines of one colour. The three electron beams which are situated in one plane are deflected by the system of deflection coils 13.

Figure 2:
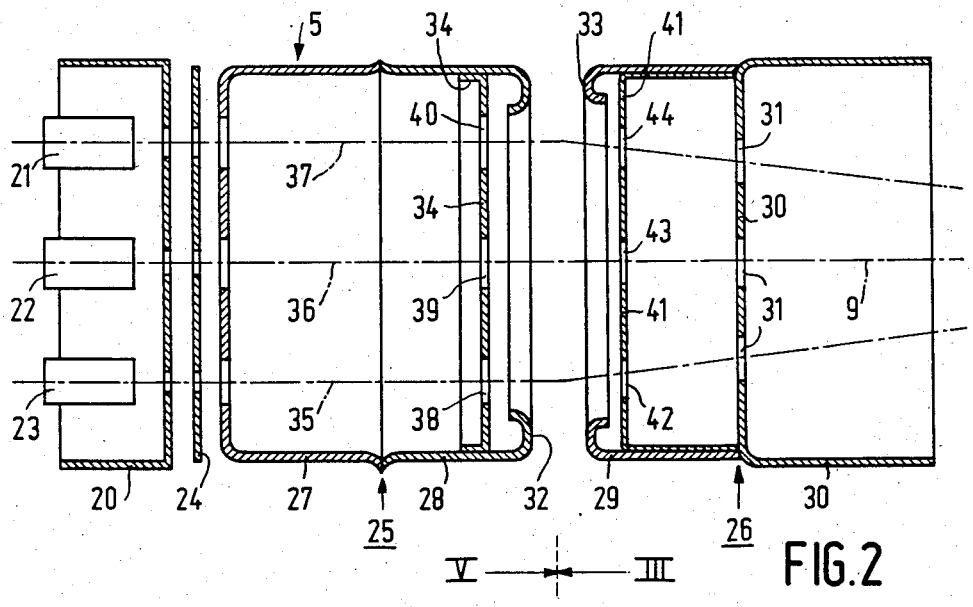
FIG. 2 is a longitudinal sectional view of an electron gun system as used in the colour display tube of FIG. 1.

FIG. 2 is a longitudinal sectional view of the electron gun system as used in the colour display tube shown in FIG. 1. The electron gun system comprises a common cup-shaped control electrode 20 in which three cathodes 21, 22 and 23 are provided, and a common plate-shaped anode 24. The three electron beams situated with their axes in one plane are focused by means of the electrodes 25 and 26 which are common for the three electron beams. Electrode 25 consists of two cup-shaped parts 27 and 28 which are connected together at their open ends. Electrode 26 comprises one cup-shaped part 29 and a centering sleeve 30, the bottom of which has apertures 31 through which the electron beams pass. Electrode 25 has an outer rim 32 extending towards electrode 26 and electrode 26 has an outer rim 33 extending towards electrode 25. Apertures 38, 39 and 40 are provided in a recessed part 34 which extends at right angles to the axes 35, 36 and 37 of the electron beams 6, 7 and 8. Apertures 42, 43 and 44 are provided in a recessed part 41 which extends substantially at right angles to the axis 36 of the central electron beam. The recessed parts 34 and 41 can form one assembly with the parts 28 and 29, respectively, just like in the electron gun which is disclosed in U.S. Pat. No. 4,370,592. The apertures in the recessed parts may also comprise collars. Because the rim 33 defines a larger aperture than rim 32, the electron beams converge after the focusing lens. However, it is also possible to let the electron beams converge in or after the triode part of the electron gun which is formed by the cathode and the electrodes 20, 24 and 25. See for example, U.S. Pat. No. 4,291,251 which may be considered to be incorporated herein by reference. The wall of the electrodes 25 and 26 is, for example, 0.25 mm thick. The gap between the electrodes 25 and 26 is, for example, 1 mm wide. The distance between the axes of the electron beams 35, 36 and 36, 37 is, for example, 4.45 mm.

Figure 3:
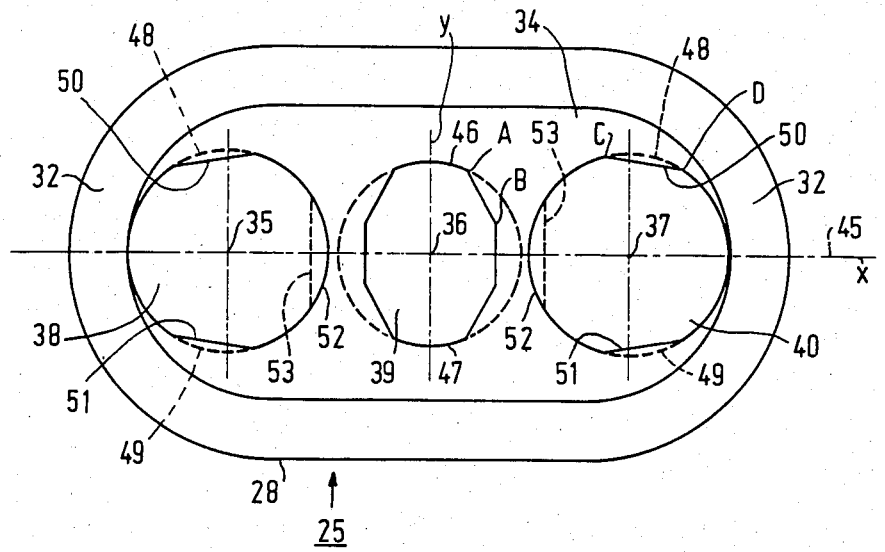
FIG. 3 is an elevation of a lens electrode of FIG. 2.

FIG. 3 is an elevation of lens electrode 25 of FIG. 2. By making the aperture 39 to be substantially octagonal and elongate, the long axis being at right angles to the plane through the beam axes 35, 36 and 37, the line of intersection 45 of which with the plane of the drawing being shown, the eight-pole component which is formed in the focusing lens field by the rims 32 and 33 is substantially compensated for, in addition to the horizontal/vertical astigmatism. The corners of the octagon may be rounded off with which also higher-order multipoles are compensated for. It is also possible to construct the sides 46 and 47, which are shown as parts of a circle, to be straight. By making the apertures 38 and 40 to be substantially pear-shaped, the edges of the apertures with distance from the central aperture 39, the six-pole component which is formed in the focusing lens field by the rims 32 and 33, is substantially compensated for.

Such pear-shaped apertures can easily be realized by starting from a circle (broken lines), parts (48,49) of the circle being replaced by their chords (50,51).

A pear-shaped aperture realized in this manner has an edge having the shape of an isosceles trapezium, the base and the top line being replaced by arcs of a circle. A part of the arc 52 may be replaced by its chord 53 (shown in broken lines).

The outermost broken-line circles have a radius of, for example 2.15 mm and the central circle has a radius of 1.9 mm. The beam axes 35 and 36 and the beam axes 36 and 37 are, for example, 4.45 mm apart. In a system of axes X-Y with the point of intersection in the plane of the drawing having axis 36 as its centre, the corner points A, B, C and D are situated in the locations indicated in the table.

| | X (mm) | Y (mm) |
|---|---|---|
| A | 0.8 | 1.72 |
| B | 1.56 | 0.65 |
| C | 3.96 | 2.09 |
| D | 5.46 | 1.90 |

The rim 32 extends 2 mm above the recessed part 34. The apertures 38 and 40 are identical and symmetrical with respect to the X-axis. Aperture 39 is situated symmetrically with respect to the X-axis and the Y-axis.

Figure 4:
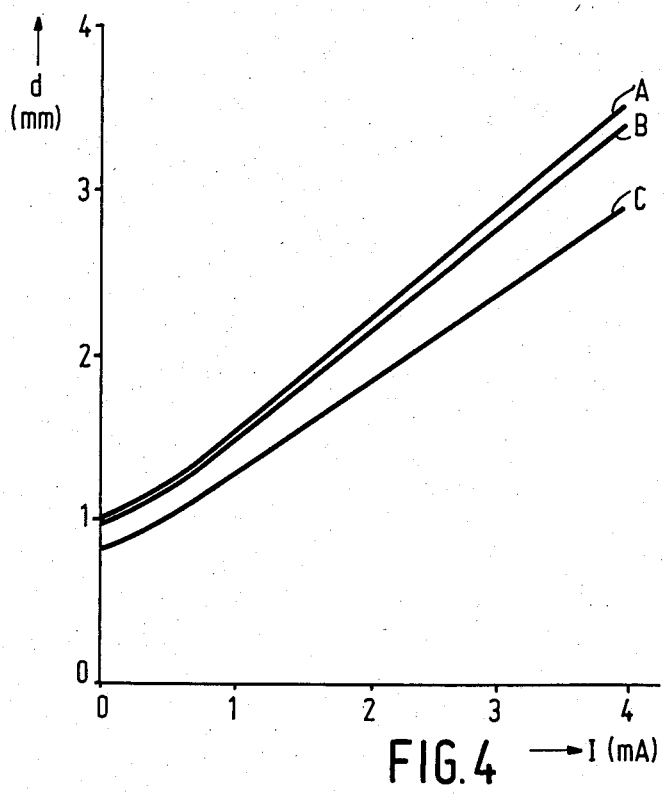
FIG. 4 shows the diameter of the spot on the display screen as a function of the beam current for three colour display tubes.

FIG. 4 shows the spot diameter d (in mm) on the display screen as a function of the electron beam current I (in mA) for the central electron beam of three electron guns. Line A is the variation of the spot diameter as a function of the beam current in an electron gun of the conventional type without a rim and recessed part. Line B is the variation of the spot diameter as a function of the beam current in an electron gun according to U.S. Pat. No. 4,370,592 which may be considered to be incorporated herein. Line C denotes the variation of the spot diameter as a function of the beam current in an electron gun for a colour display tube according to the invention. The electrodes 25 and 26 are constructed in accordance with FIGS. 2 and 3. From this comparison it follows that, by using the invention, the spot diameter is smaller both at high and at low beam currents, as a result of which a sharper picture can be displayed. In tubes according to the invention a 10 to 20% smaller spot was established than in tubes in which the invention was not used. By using apertures as shown in FIG. 3 in electrode 25, the desired eight-pole and six-pole component corrections can be obtained in addition to the four-pole component correction. By making the apertures shown to be more or less elongate, the four-pole component in the focusing lens field at the area of the beams can also be compensated as desired or be adjusted at a given value. By using the same shape for the aperture as in FIG. 3 in electrode 26, the six-pole correction and the eight-pole correction are attenuated. The use of identical lens components, however, has advantages to which will be referred hereinafter.

Figure 5:
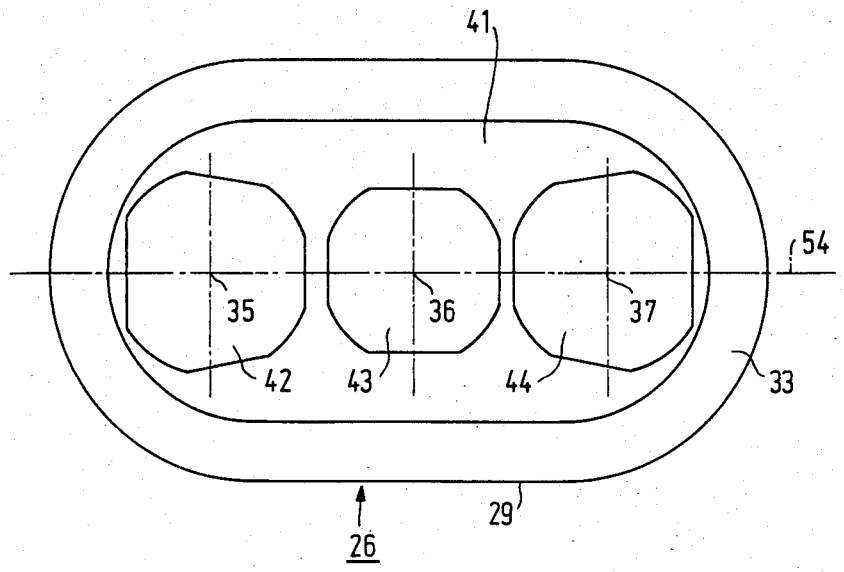
FIG. 5 is another elevation of a lens electrode of FIG. 2.

FIG. 5 shows another embodiment of the lens electrode 26 of FIG. 2. Aperture 43, as aperture 39 in FIG. 3, is substantially octagonal and elongate. The long axis of the aperture, however, now lies in the plane through the electron beam axes of which the line of intsection 54 with the plane of the drawing is shown. By such a shape of the aperture, the eight-pole component which is formed in the focusing lens field by the rims 32 and 33 is subtantially compensated in addition to the four-pole component. The apertures 42 and 44 are substantially pear-shaped, but the apertures diverges with distance from the central aperture 43. The six-pole component which is formed in the focusing lens field by the rims 32 and 33 is compensated substantially by the apertures. The different orientations of the apertures in electrode 26 are compared with the orientations of the aperture in electrode 25 is the result of the fact that the focusing lens may be considered to be composed of a positive lens part followed by a weaker negative lens part. By reducing the width of the aperture in a given direction in electrode 25, the lens becomes stronger in that direction because the positive lens part is situated near electrode 25. By reducing the width of the aperture in electrode 26 in the same direction, the lens becomes weaker in that direction, because the negative lens part is situated near electrode 26. From this it follows that the widths of the apertures in the electrodes 25 and 26 must be varied oppositely to each other to produce the same effect.

However, if the apertures in the electrodes 25 and 26 have the same shape, a correction nevertheless takes place because the positive lens part is always stronger than the negative lens part. The choice of the same shape of the apertures in the electrodes 25 and 26 may be attractive for technical reasons in production. As described in Netherlands Patent Application No. 8203320 (corresponding to U.S. application Ser. No. 802,068 filed Nov. 25, 1985, which is a continuation of U.S. application Ser. No. 516,028 filed July 22, 1983) which is not yet laid open to public inspection and which may be considered to be incorporated herein, the astigmatism of the electron beams can also be reduced by making the lens electrode components between which the lens field is formed in an operating electron gun to be identical. The lens electrode components should be provided so that the corresponding sides are facing each other and the corresponding apertures are opposite to each other. By providing identical components for the lens electrodes opposite to each other in the manner described it is achieved that the deviations from the desired shape of the oppositely located apertures, which deviations have arisen during the manufacture of the apertures, are approximately equally large. As a result of this the disturbing influence on the electron beams for the two lens electrodes is also approximately equally large, but of opposite sign, as a result of which the astigmatism resulting from the deviations becomes smaller.

Figure 6:
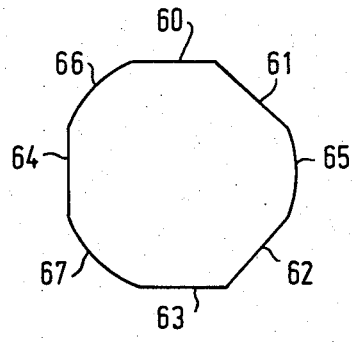
FIG. 6 shows an alternative pear-shaped aperture.

The pear-shaped apertures may also be constructed as is shown in FIG. 6. The straight lines 60, 61, 62, 63 and 64 again are chords of a circle of which the arcs 65, 66 and 67 are still left.

It is also possible to obtain the four-, six- and eight-pole components in the focusing lens field by making the apertures in the recessed parts circular and providing them with collars of which the height, proceeding along the circumference, varies in height (corrugated collars). However, these collars are difficult to manufacture by means of polygonal drawing dies, for example a hexagonal or octagonal drawing die in a plate having round apertures. It is also possible to use a circular drawing die in a plate having hexagonal or octagonal apertures. The collars may also be made oblique so as to produce convergence.

What is claimed is:

1. A color display tube comprising an evacuated envelope containing a luminescent screen and an electron gun system for producing a central electron beam and first and second outer electron beams along respective axes lying in a single plane, said electron gun system including first and second spaced-apart electrodes for producing therebetween a focusing lens field to focus the electron beams at the luminescent screen, said electrodes having facing rims extending from respective first and second recessed parts, each of said recessed parts extending transversely with respect to the axes and having central and first and second outer apertures for passing the respective electron beams; characterized in that:

(a) the central aperture in at least one of the recessed parts is elongate, is symmetrically disposed with respect to said plane, and is shaped to effect production in the region of the focusing lens field traversed by the central electron beam of a quadrupole component and a compensating eight-pole component; and (b) each of the outer apertures in at least one of the recessed parts is non-circular, has a width which changes with distance from the central beam axis, is symmetrically disposed with respect to said plane, and is shaped to effect production in the region of the focusing lens field traversed by the respective outer electron beam of a quadrupole component and a compensating six-pole component.

2. A color display tube as in claim 1 where each of the rims extend from the respective recessed parts by a distance of approximately 10–25% of the largest transverse dimension of the respective recessed part.

3. A color display tube as in claim 1 or 2 where the central aperture in at least one of the recessed parts is octagonal-shaped and where the outer apertures in at least one of the recessed parts is pear-shaped.

4. A color display tube comprising an evacuated envelope containing a luminescent screen and an electron gun system for producing a central electron beam and first and second outer electron beams along respective axes lying in a single plane, said electron gun system including first and second spaced-apart electrodes for producing therebetween a focusing lens field to focus the electron beams at the luminescent screen, said electrodes having facing rims extending from respective first and second recessed parts, each of said recessed parts extending transversely with respect to the axes and having central and first and second outer apertures for passing the respective electron beams; characterized in that:

(a) the central aperture in the first recessed part has an elongate octagonal shape with a longitudinal axis extending perpendicularly to said plane, said central aperture effecting production in the region of the focusing lens field traversed by the central electron beam of a quadrupole component and a compensating six-pole component; and (b) each of the outer apertures in the first recessed part is pear-shaped and has a width which decreases with distance from the central axis, said outer apertures each effecting production in the region of the focusing lens field traversed by the respective outer electron beam of a quadrupole component and a compensating six-pole component.

5. A color display tube comprising an evacuated envelope containing a luminescent screen and an electron gun system for producing a central electron beam and first and second outer electron beams along respective axes lying in a single plane, said electron gun system including first and second spaced-apart electrodes for producing therebetween a focusing lens field to focus the electron beams at the luminescent screen, said electrodes having facing rims extending from respective first and second recessed parts, each of said recessed parts extending transversely with respect to the axes and having central and first and second outer apertures for passing the respective electron beams; characterized in that:

(a) the central aperture in the second recessed part has an elongate octagonal shape with a longitudinal axis extending in said plane, said central aperture effecting production in the region of the lens field traversed by the central electron beam of a quadrupole component and a compensating eight-pole component; and (b) each of the outer apertures in the second recessed part is pear-shaped and has a width which increases with distance from the central axis, said outer apertures each effecting production in the region of the focusing lens field traversed by the respective outer electron beam of a quadrupole component and a compensating six-pole component.

6. A color display tube as in claim 4 or 5 where each of the pear-shaped apertures is in the form of an isosceles trapezium having two sides intersecting said plane which are formed by arcs of a circle.

* * * * *

UNITED STATES PATENT AND TRADEMARK OFFICE

CERTIFICATE OF CORRECTION

PATENT NO. : 4,626,738

DATED : December 2, 1986

INVENTOR(S) : Hans G. Gerlach

It is certified that error appears in the above-identified patent and that said Letters Patent is hereby corrected as shown below:

On the title page, Foreign Application Priority Data "8302752" should read -- 8302773 --.

Signed and Sealed this

Seventeenth Day of January, 1989

*Attest:*

DONALD J. QUIGG

*Attesting Officer*

*Commissioner of Patents and Trademarks*